US007021381B1

(12) United States Patent
Remedies et al.

(10) Patent No.: US 7,021,381 B1
(45) Date of Patent: Apr. 4, 2006

(54) METHOD AND APPARATUS FOR REMOVING CASING

(75) Inventors: Sandra Remedies, La Place, LA (US); John Rucker, La Place, LA (US); Richard Blanchard, Metairie, LA (US); Donald D. Deslatte, La Place, LA (US); Kenneth Cahill, La Place, LA (US)

(73) Assignee: Hudson Services, Inc., LaPlace, LA (US)

( * ) Notice: Subject to any disclaimer, the term of this patent is extended or adjusted under 35 U.S.C. 154(b) by 156 days.

(21) Appl. No.: 10/673,959

(22) Filed: Sep. 29, 2003

(51) Int. Cl.
*E21B 29/08* (2006.01)
*E21B 19/16* (2006.01)

(52) U.S. Cl. ..... 166/298; 166/377; 166/55.2; 166/85.1

(58) Field of Classification Search ..... 166/377, 166/298, 297, 55.2, 85.1, 55; 408/37, 41, 408/117, 118, 702
See application file for complete search history.

(56) References Cited

U.S. PATENT DOCUMENTS

| | | | | |
|---|---|---|---|---|
| 2,390,420 | A * | 12/1945 | Burke | 408/41 |
| 2,449,429 | A | 9/1948 | Degrift | |
| 3,266,199 | A | 8/1966 | Bryson | |
| 3,826,585 | A * | 7/1974 | Horton et al. | 408/41 |
| 3,847,501 | A | 11/1974 | Doty | |
| 4,146,350 | A | 3/1979 | Bokelmann | |
| 4,860,413 | A * | 8/1989 | Woodward | 29/38 C |
| 4,902,174 | A | 2/1990 | Thompson et al. | |
| 5,025,842 | A | 6/1991 | Brimhall | |
| 5,893,686 | A | 4/1999 | Weiler | |
| 6,827,145 | B1 * | 12/2004 | Fotland et al. | 166/298 |
| 2002/0076285 | A1 | 6/2002 | Tsune | |

* cited by examiner

*Primary Examiner*—Kenneth Thompson
(74) *Attorney, Agent, or Firm*—Garvey, Smith, Nehrbass & North, L.L.C.; Brett A. North

(57) ABSTRACT

A method and apparatus for removing a string of casing from a well bore. The method and apparatus include a plurality of drill bits substantially aligned with each other for drilling a plurality of holes in the string of casing. The plurality of holes can be used to lift the string in casing from the well bore via a series of incremental casing sections.

22 Claims, 4 Drawing Sheets

METHOD AND APPARATUS FOR REMOVING CASING

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates generally to oil and gas wells and, more specifically, to a system for removing casing which has been placed in a well bore.

The process of drilling subterranean wells to recover oil and gas from reservoirs, consists of boring a hole in the earth down to the petroleum accumulation in the reservoir, and installing pipe from the reservoir to the surface. Casing is a protective pipe liner within the well bore that is cemented in place to ensure a pressure-tight connection to the oil and gas reservoir. The casing can be run from the rig floor as it is lowered into the well bore. After the casing has been run to the desired depth it is typically cemented within the well bore. The purpose of cementing is to seal the casing to the well bore formation.

Sometimes after a string of casing has been cemented, it must be removed for one or more reasons (such as plug and abandoning the well bore or removing the casing so that the well can be redrilled, called sidetracked, if for some reason the drill bit cannot pass through the previously installed casing or matter located downhole). This invention potentially saves several hours of drill rig time (from 2 hours to ½ hour) for removing the casing and is used for removing casing that was previously cemented in place. Removing the casing is a difficult job because of the tremendous amount of force which must be placed on the casing to pull it out of the ground. The casing was cemented in the ground generally to keep it in place. Accordingly, not only must the weight of the casing be pulled out of the well bore, but also the weight of the cement along with overcoming the frictional forces caused by the cement interacting with the sidewall of the well bore.

In prior art systems the casing was removed by incremental sections, such as forty foot increments. For an incremental section of casing, casing operators would cut the casing and manually drill two holes. The two holes were drilled on either side of the casing attempting to have them aligned with each other. After the holes had been drilled, a bar or rod would be placed through the two holes. The bar or rod would then be pulled up by the rig's top drive unit or the draw works a specified incremental amount, such as forty feet. As discussed above, in raising the casing a tremendous amount of force was required to overcome the resisting forces. After the incremental section of casing had been raised, the cutting and drilling process would start over again for the next incremental section of casing. After the various increments of casing were cut and pulled from the well bore, they would be disposed of.

In prior art systems, operators would attempt to individually and sequentially drill the two holes in each incremental section of casing. The operator would first drill one side.

Depending on the thickness of the wall to be drilled, drilling would have to be intermittently stopped and all drilled material removed from the drill bit. This process would take much time and slow down the removal of the casing (such as 2 hours). Second, the operator would go around to the other side of the casing and attempt to drill a second hole opposite the first hole. Again, intermittent breaks to unclog the drill bit would be required. Sometimes, the operator got lucky and the two holes lined up, but at other times the two holes did not line up and a bar could not be inserted through both holes. When the two holes did not line up, the operator using a torch would have to chip and cut at least one of the holes to open it up so that the bar could be placed through both holes.

This process took much rig time and created a hazardous working environment when using a torch and was potentially repeated for each incremental section of casing.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. Provided is a method and apparatus for removing casing from a well bore. More specifically, the present invention solves the above problems by having a plurality of drills and a collar system for drilling two holes whereby the drills can be aligned with each other. Additionally, both holes can be drilled substantially simultaneously reducing drill time.

Both drills can be pneumatically powered to avoid fire risks. The drills can be mounted on a collar which is attached to the casing to be drilled. After both holes are drilled a bar can be placed through the two holes and a collar attached to the bar. The collar can be attached to the rig's top drive unit or draw works and the casing pulled an incremental amount, such as forty feet. The incremental amount pulled can vary by rig size, rig components, operator preference—and can change from pull to pull. For example, an incremental amount pulled can vary from five feet to ninety feet. After being pulled and cut, the incremental section of casing can be properly disposed of.

Drill bits can be sized to allow the bits to go completely through very thick portions of casing with cement layers attached thereon—drilling to the casing's interior without periodically cleaning/emptying the drill bits. Additionally, during the drilling process, the bits can be lubricated with fluid, such as by water, to prevent sparks and cooling thereby allowing drilling to continue all the way through the cement and casing thickness without stopping for cooling down/cleaning out periods.

The present invention provides a more efficient operation significantly improving the speed and safety of removing casing from a well bore.

These and other objects, features, and advantages of the present invention will become apparent from the drawings, the descriptions given herein, and the appended claims. The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein.

It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

It will be understood that such terms as "up," "down," "vertical" and the like are made with reference to the drawings and/or the earth and that the devices may not be arranged in such positions at all times depending on variations in operation, transportation, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention.

Figure 1:
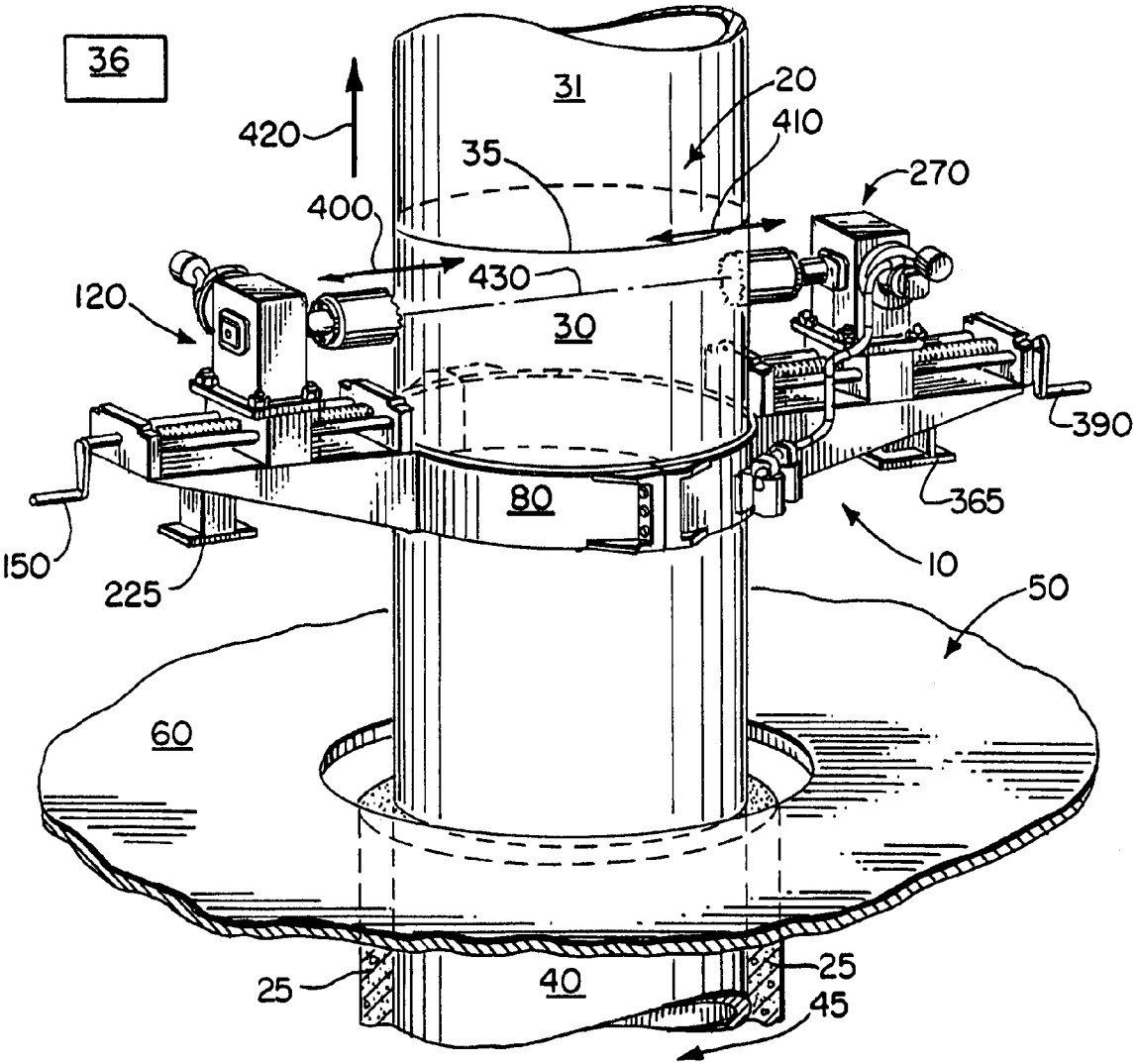
FIG. 1 is a perspective view of a preferred embodiment of the system attached to a joint of casing.

FIG. 1 is a perspective view of a preferred embodiment of recovery system 10 shown attached to casing 20. Casing 20, comprising upper and lower sections 30, 40, had previously been cemented in well bore 45 and is to be removed. Casing 20 can be removed in incremental sections (such as in forty foot increments) and can be pulled up in incremental sections from well bore 45 in the direction of arrow 420, by using traveling block 470 and bar 460 combined with fitting/shackle 480 (not shown).

For the first section of casing 20 to be removed, a cut line 35 can be made using a casing cutting tool 36 and the upper incremental section of casing 31 above the cut line 35 can then be removed. Before making cut line 35 and below cut line 35, slips for rig 50 can be connected to casing 20 for holding lower section 40 of casing 20 and preventing it from dropping down well bore 45.

Figure 3:
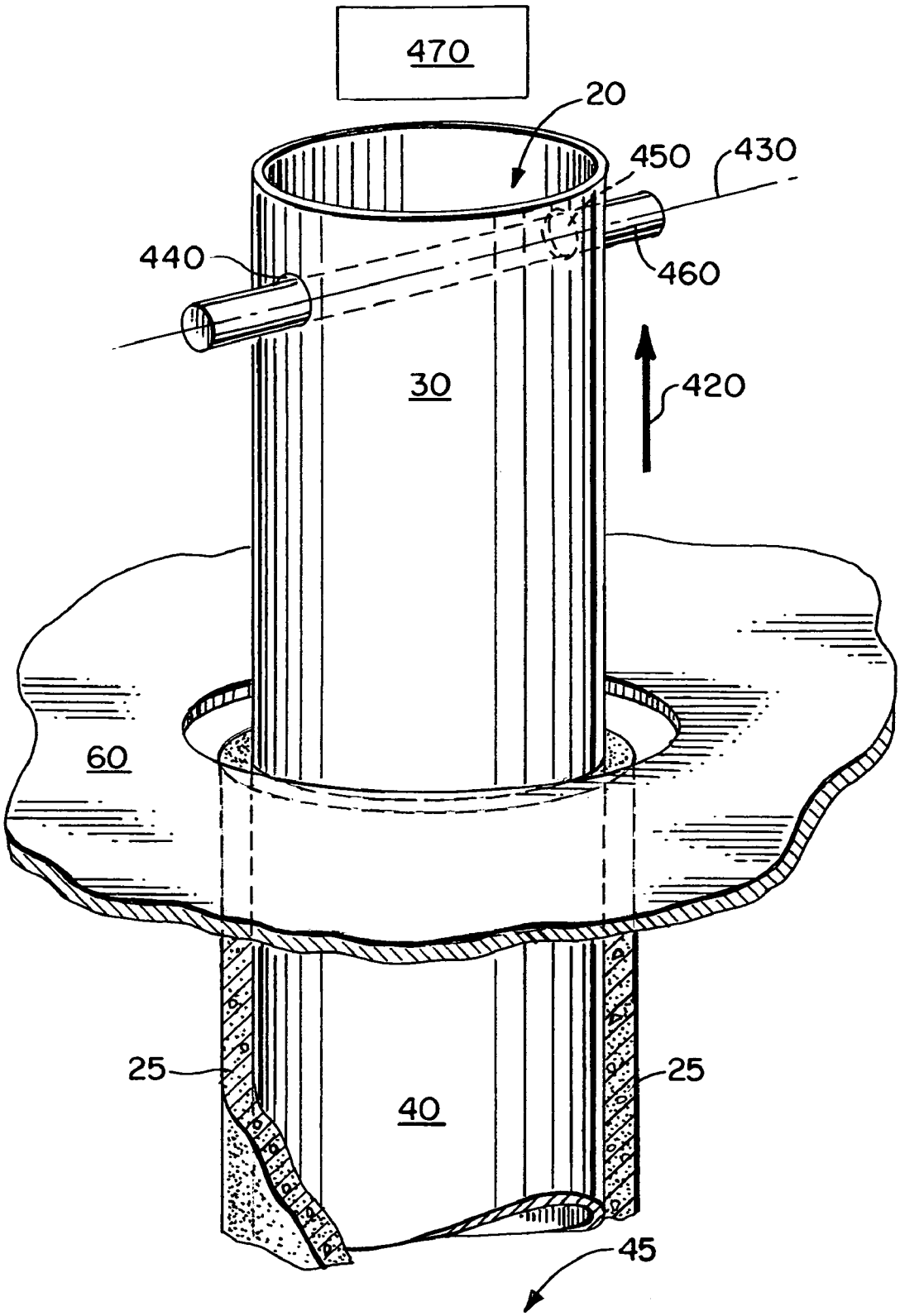
FIG. 3 is a perspective view of casing which has been drilled by the system shown in FIG. 1.
Figure 4:
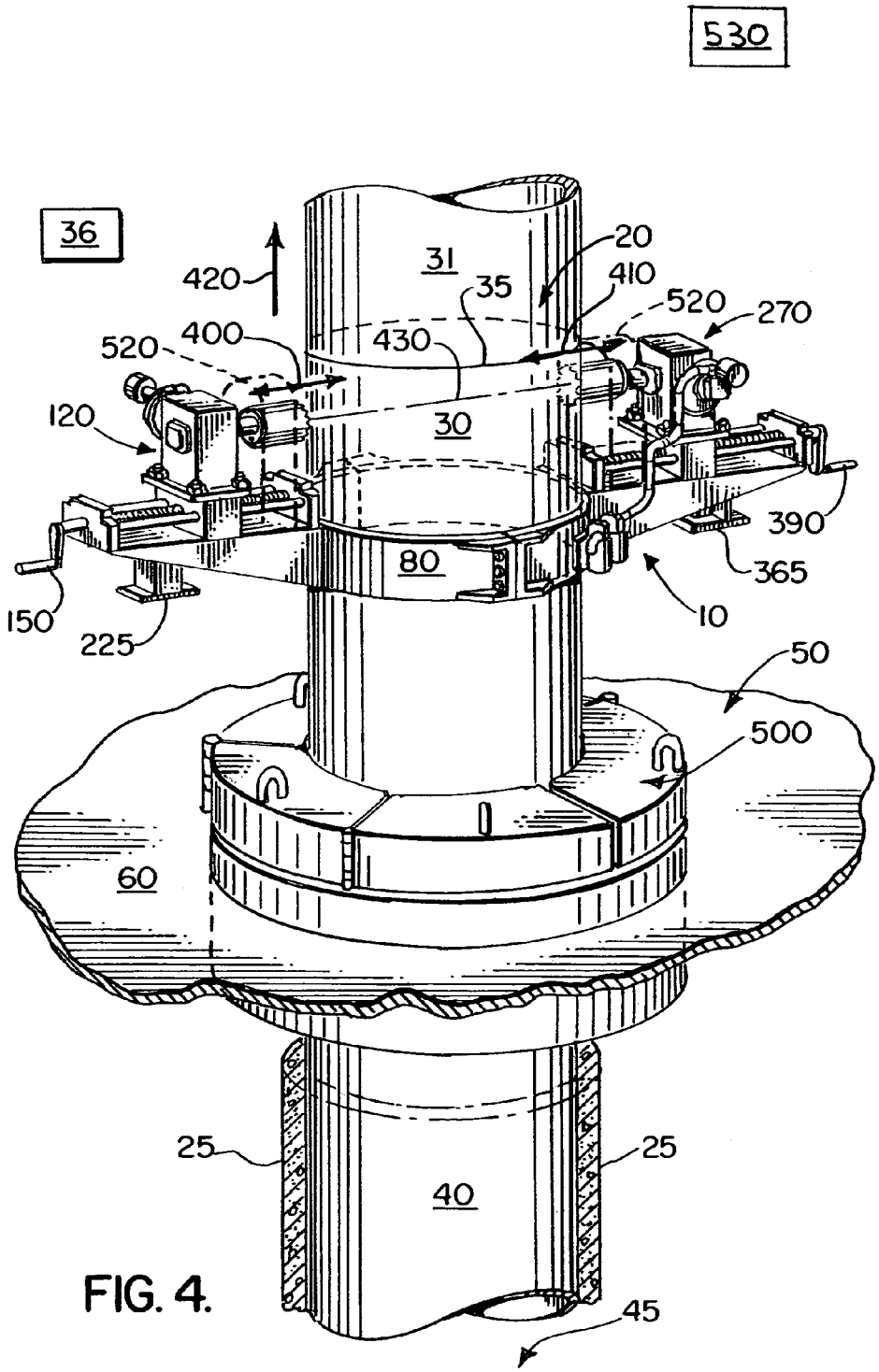
FIG. 4 is a perspective view of the embodiment shown in FIG. 1 with the addition of guards, slips, and schematically indicating the addition of fluid during drilling.

Preferably, after making cut line 35, recovery system 10 can be connected to the remaining portion of casing 20 to create to holes for raising and removing another incremental section of casing 20. Recovery system 10 can be connected prior to making cut line 35, but doing so may interfere with the cutting operation. Recovery system 10 can be attached to casing 20 by clamp 80. Using handles or cranks 150 and 390, drills 120 and 270 drill into casing 20 in the direction of arrows 400, 410 and along centerline 430 creating openings 440 and 450 (FIG. 3). Casing 20, comprising upper and lower sections 30, 40, can be partially pulled up from well bore 45 in the direction of arrow 420, by using traveling block 470 and bar 460 combined with fitting/shackle 480 (not shown). Slips for rig 50 can again be connected to casing 20 and used to hold lower section 40 after casing 20 is cut. Below the slips a new cut line 35 can be made and another incremental section 31 of casing 20 (above the new cut line 35) can be removed.

Recovery system 10 can again be attached to casing 20 by clamp 80. Using handles or cranks 150 and 390, drills 120 and 270 drill into casing 20 in the direction of arrows 400, 410 and along centerline 430 creating openings 440 and 450 (FIG. 3). Bar 460 combined with fitting 480 (not shown) can then be installed in the new holes 440, 450. Another incremental section of casing 20, comprising upper and lower sections 30, 40, can again be pulled up from well bore 45 in the direction of arrow 420, by using traveling block 470 and bar 460 combined with fitting/shackle 480 (not shown). Slips for rig 50 can be connected to casing 20 and used to hold lower section 40 after casing 20 is cut. Above the slips a new cut line 35 can be made and the incremental casing section above the new cut line 35 can be removed. For making new holes recovery system 10 can again be attached to casing 20.

The process can be repeated until the entire length of casing 20 is pulled from well bore 45 via incremental sections 31. Well bore 45 can then be further worked, such as by sidetracking or plugging and abandoning.

As a casing cutting tool 36, a Guillotine saw is preferably used. A casing cutting saw can also be used, but may create increase risks when making cut 35.

Figure 2:
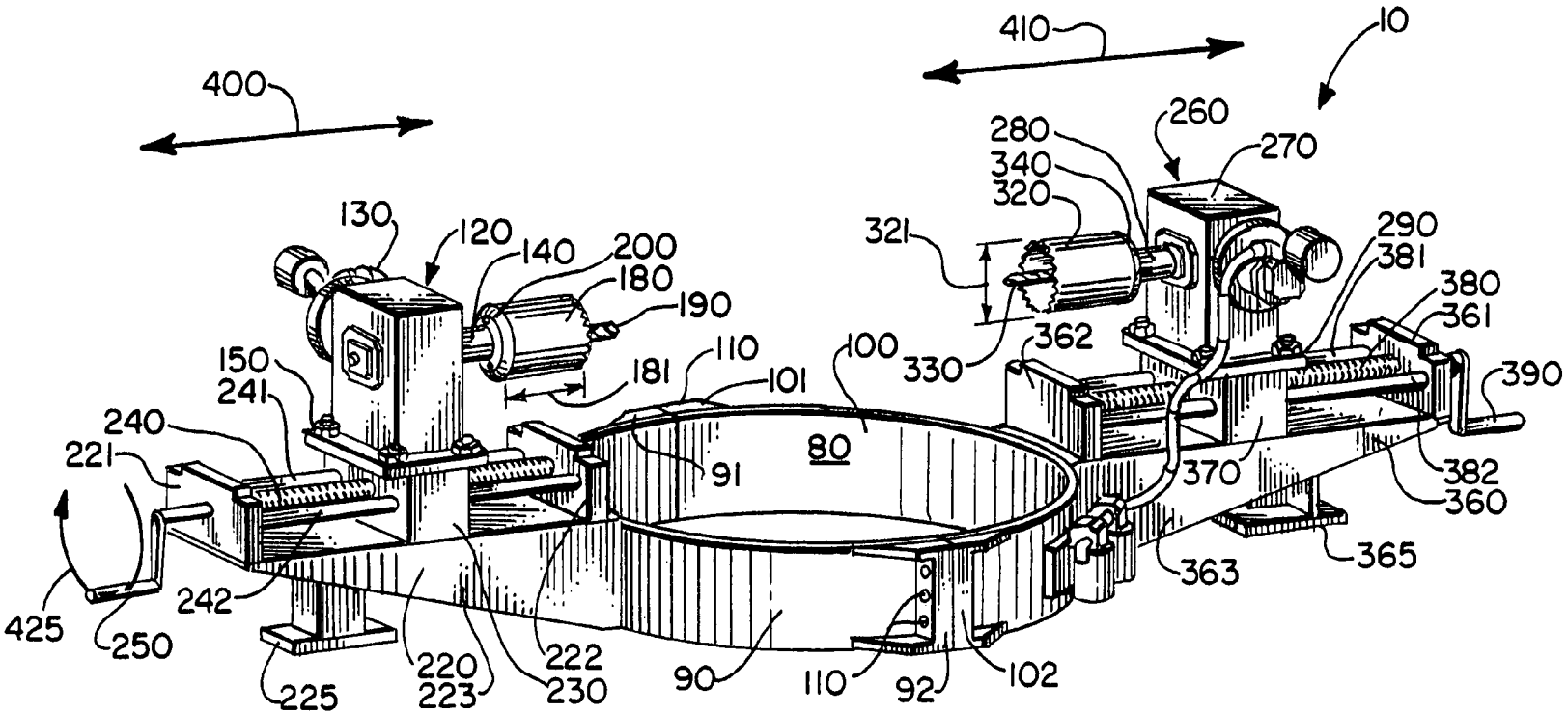
FIG. 2 is a perspective view of the system shown in FIG. 1.

FIG. 2 is a perspective view of the recovery system 10 shown in FIG. 1.

Recovery system 10 can be comprised of body 220, body 360, and clamp 30. Body 360 can be constructed substantially similar to body 220. During drilling operations clamp 80 can be used to position drills 120, 270 on either side of casing 20. Recovery system 10 can be supported by legs 225 and 365 standing on rig floor 60 of rig 50.

Clamp 80 can be comprised of first portion 90 and second portion 100. First and second portions 90, 100 can be detachably connected by a plurality of fasteners 110. First portion 90 can be connected to lower portion 223 and can comprise connector plates 91, 92. Second portion 100 can be connected to lower portion 363 and can comprise connector plates 101, 102. Clamp 80 can be sized based on the diameter of casing 20 to be removed. First and second portions 90, 100 can also be removably connected to lower portions 223, 363 (e.g., by fasteners) and a plurality of first and second portions 90, 100 can be included to address different size casings 20. Alternatively, different sized clamps 80 can be provided to address different size casings 20. Any conventionally available fastening method can be used in place of fasteners 110. For example, first and second portions 90,100 can be pivotally connected on one side with a locking bracket on the other. A plurality of bolted fasteners 110 is preferred to accommodate variations in diameter of casing 20.

FIG. 2 is a perspective view of recovery system 10 showing bodies 220 and 360 which include drills 120 and 260. Body 360 can be constructed substantially similar to body 220 and therefore only body 220 will be described in detail.

Body 220 can comprise drill 120, base 230, crank 250, first clamp portion 90, lower portion 223, and leg 225.

Drill 120 can be comprised of motor 130, shaft 140, and drill bit 180. Motor 130 is preferably pneumatically powered to minimize the risk of explosion. Depth 181 of drill bit 180 can be sized to at least accommodate the thickness of wall of casing 20 and any other obstructions which must be cut through (such as cement lining). Diameter of drill bit 180 (which can be similar to diameter 321 of drill bit 320) can be sized to accommodate the lifting apparatus (e.g., bar 460 and fitting/shackle 480) which is to be inserted through casing 20, such as bar 460 as shown in FIG. 3. Drill bit 180 can be any conventionally available drill bit and can also include a pilot bit 190 to ease initial drilling of wall of casing 20. Drill bit 180 can include priming drill bit 190 attached to the center of bit 180. Drill bit 180 attaches to shaft 140 and shaft 140 attaches to 130.

Lower portion 223 can support an ambulatory system for drill 120 linearly moving drill 120 in the directions of arrows 400. Drill 120 can be attached to base 230 via motor 130. Base 230 can move linearly with respect to lower portion 223. Base 230 can be threadably connected to drive shaft 240 and track along length of lower portion 223. Turning crank 250 in the direction of arrow 425 can move base 230 in a longitudinal direction of arrow 400 toward the center of clamp 80. Turning crank 250 in the opposite direction can move base 230 in the opposite direction. Guides 241, 242 can be used to guide base 230 when linearly moving on lower portion 223.

Before attaching recovery system 10 to casing 20, body 150 is attached to mounting rack 300. Clamp 160 was sized for the particular diameter of casing 20. First portion 170 is removed from clamp 160. Recovery system 10 is placed against casing 20 aligning hole 185 approximately at the location where casing 20 is ultimately to be cut. Mounting bracket 310 is placed against the wall of casing 20. Second portion 180 of clamp 160 should also mount against the wall of casing 20. Chain 360 is wrapped around casing 20, arms 370 and connected to connectors 380. First portion 170 of clamp 160 is attached to second portion 180 via fasteners 190. Liner 200 will make a fluid tight seal with wall of casing 20. Recovery system 10 can then be connected to pump 30 and recovery tank 120 through hoses 134 and 135.

After being connected to casing 20, motor 130 can be started rotating shaft 140 and rill bit 200. As shown in FIG. 1, crank 250 can be rotated in the direction of arrow 45 causing base 230 and drill 120 to move toward the center of casing 20. Priming drill bit 190 will first contact wall of casing 20 (or cement layer 25) making a priming hole and steadying the drilling by drill bit 180. Drill bit 180 will continue through the wall of casing 20(and through cement layer 25) creating an opening 440 the size of drill bit 180(see FIG. 3). The portion of the wall of casing 20 (and cement layer 25) which is cut out will be contained in the interior of drill bit 180. Crank 250 is then turned in the opposite direction of arrow 425 causing drill bit 180 move in the opposite direction. As stated above the operation of drill 260 and crank 390 is substantially similar to drill 120 and crank 250 (and will not be specifically described). However, it should be noted that drill 260 and crank 390 can be operated simultaneously or separately with drill 120 and crank 250.

After holes 440, 450 are drilled, recovery system 10 is removed from casing 20 (such as by releasing fasteners 110) and an apparatus, such as bar 460, can be placed between holes 440, 450. A incremental section of casing 20, comprising upper section 30 and lower section 40, can then be pulled up, such as by using traveling block 470. A similar process is performed for the next incremental section of casing 20, and continued until each incremental section of casing has been pulled from well bore 45. After complete removal of casing 20, further work on well bore 45 can be performed, such as sidetracking or plugging and abandoning.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various elements may be made without departing from the spirit of the invention.

The following is a list of reference numerals:

LIST OF REFERENCE NUMERALS

| (Reference No.) | (Description) |
|---|---|
| 10 | recovery system |
| 20 | casing |
| 25 | cement layer |
| 30 | upper section of casing |
| 31 | upper section of casing |
| 35 | cut line |
| 36 | casing cutting tool |
| 40 | lower section of casing |
| 45 | well bore |
| 50 | rig |
| 60 | rig floor |
| 70 | body of recovery system |
| 80 | clamp |
| 90 | first portion of clamp |
| 91 | connector plate |
| 92 | connector plate |
| 100 | second portion of clamp |
| 101 | connector plate |
| 102 | connector plate |
| 110 | fasteners |
| 120 | drill |
| 130 | motor |
| 140 | shaft |
| 150 | base |
| 160 | end |
| 170 | keyway |
| 180 | drill bit |
| 181 | dimension line |
| 190 | priming drill bit |
| 200 | base of drill bit |
| 210 | guard |
| 220 | body |
| 221 | first end |
| 222 | second end |
| 223 | lower portion |
| 225 | leg |
| 230 | base for motor |
| 240 | drive shaft |
| 241 | guide |
| 242 | guide |
| 250 | crank |
| 260 | drill |
| 270 | motor |
| 280 | shaft |
| 290 | base |
| 300 | end |
| 310 | keyway |
| 320 | drill bit |
| 321 | dimension line |
| 330 | priming drill bit |
| 340 | base of drill bit |
| 350 | guard |
| 360 | body |
| 361 | first end |
| 362 | second end |
| 363 | lower portion |
| 365 | leg |

-continued

| LIST OF REFERENCE NUMERALS | |
|---|---|
| (Reference No.) | (Description) |
| 370 | base for motor |
| 380 | drive shaft |
| 381 | guide |
| 382 | guide |
| 390 | crank |
| 400 | arrow |
| 410 | arrow |
| 420 | arrow |
| 425 | arrow |
| 430 | centerline |
| 440 | opening |
| 450 | opening |
| 460 | bar |
| 470 | traveling block |
| 480 | fitting/shackle |
| 500 | slips |
| 520 | guards |
| 530 | addition of lubricant to drill bits, such as water |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A casing removal system, comprising:

a) a body, the body including first and second portions;

b) a clamp, the clamp being attached to the first and second portions of the body, the clamp being mountable around a section of casing which has been installed in a well bore;

c) a first drill movably mounted on the first portion of the body, the first drill comprising a first drill bit having a longitudinal axis, the first drill bit being rotatably connected to the first drill;

d) a second drill movably mounted on the second portion of the body, the second drill comprising a second drill bit having a longitudinal axis, the second drill bit being rotatably connected to the second drill; and e) wherein, when the clamp is mounted on the section of casing the longitudinal axis of the first drill bit is substantially aligned with the longitudinal axis of the second drill bit, wherein the clamp further comprises first and second sections, the first and second sections being connectable by a plurality of fasteners.

2. The casing removal system of claim 1, wherein the first and second sections of the clamp are half-cylindrically shaped.

3. The casing removal system of claim 1, wherein the first and second sections of the clamp are connected by a hinge on one side a plurality of fasteners on the other side.

4. The casing removal system of claim 1, wherein the clamp conforms to the shape of the joint of casing.

5. The casing removal system of claim 1, wherein the first portion of the body further comprises a first handle operatively connected to the first drill and activation of the first handle causes movement of the first drill in a linear direction and wherein the second portion of the body further comprises a second handle operatively connected to the second drill, and activation of the second handle causes movement of the second drill in a linear direction.

6. The casing removal system of claim 1, further comprising a first guard attached to the first portion and restricting access to the first drill bit, and further comprising a second guard attached to the second portion and restricting access to the second drill bit.

7. The casing removal system of claim 1, further comprising a first pilot drill bit, the first pilot drill bit being attached to the first drill bit and a second pilot drill bit, the second pilot drill bit being attached to the second drill bit.

8. The casing removal system of claim 1, wherein at least two of the plurality of fasteners are substantially parallel to the longitudinal axes of the first and second drill bits.

9. The casing removal system of claim 4, wherein the clamp has an interior surface, and substantially all of the interior surface contacts the joint of casing.

10. The casing removal system of claim 5, wherein the first portion of the body further comprises a first base operatively connected to the first handle and also connected to the first drill, and activation of the first handle causes movement of the first base in a linear direction and wherein the second portion of the body further comprises a second base operatively connected to the second handle and also connected to the second drill, and activation of the second handle causes movement of the second base in a linear direction.

11. The casing removal system of claim 5, wherein the first and second handles are activated by rotation.

12. The casing removal system of claim 10, wherein the first and second handles are activated by rotation.

13. The casing removal system of claim 10, wherein the first base is threadably connected to the first handle.

14. The casing removal system of claim 10, wherein the first portion of the body further comprises a first plurality of guides slidingly connected to the first base and guiding linear movement of the first base, and wherein the second portion of the body further comprises a second plurality of guides slidingly connected to the second base and guiding linear movement of the second base.

15. A method of removing a joint of casing from a well bore, comprising:

a) attaching a plurality of slips on a string of casing located in the well bore;

b) making a cut line which divides the string of casing into upper and lower sections;

c) removing the upper section of the string of casing;

d) connecting a casing removal system on the joint of casing;

e) the casing removal system in step "d" comprising a body, the body including first and second ends, first and second drill bits operatively connected to the first and second ends, the first and second drill bits having longitudinal axes substantially aligned with each other;

a clamp, the clamp connecting the first and second ends;

f) drilling holes in the joint of casing with the first and second drill bits; and g) pulling up the lower section of the string of casing from the well bore using the drilled holes.

16. The method of claim 15, wherein in step "c" the first and second drill bits are caused to be moved in a linear direction with first and second handles.

17. The method of claim 15, before completion of step "c," further comprising the step of drilling first and pilot holes in the joint of casing using a plurality of pilot drill bits.

18. The method of claim 15, further including the step of placing a bar through the holes of the joint of casing in step "f."

19. The method of claim 15, wherein during step "f" a fluid is added to lubricate the drill bits.

20. The method of claim 15, wherein a guillotine saw is used to make the cut line in step "b."

21. The method of claim 18, wherein in step "g" a traveling block is used to pull up the lower section of the string of casing.

22. The method of claim 19, wherein the fluid is water.

* * * * *